US005830075A

United States Patent [19]

Hirose

[11] Patent Number: 5,830,075

[45] Date of Patent: Nov. 3, 1998

[54] GOLF CLUB

[76] Inventor: Tokuzo Hirose, 13-13, Higashiyama-cho, Ashiya-shi, Hyogo, Japan

[21] Appl. No.: 895,133

[22] Filed: Jul. 16, 1997

[30] Foreign Application Priority Data

Jan. 13, 1997 [JP] Japan ..... 9-004108

[51] Int. Cl.[6] ..... A63B 53/00; A63B 53/04

[52] U.S. Cl. ..... 473/313; 473/314; 473/340; 473/330

[58] Field of Search ..... 473/324, 330, 473/331, 313, 314, 340, 341, 287, 290

[56] References Cited

U.S. PATENT DOCUMENTS

| | | | |
|---|---|---|---|
| 4,162,074 | 7/1979 | Thomson | 473/330 |
| 4,664,385 | 5/1987 | Macera | 473/330 |
| 4,795,158 | 1/1989 | Kuykendall | 473/340 |
| 5,303,923 | 4/1994 | Garcia | 473/330 |
| 5,344,149 | 9/1994 | Miller | 473/340 |
| 5,383,664 | 1/1995 | Epperson | 473/340 |
| 5,467,987 | 11/1995 | Perkins | 473/340 |
| 5,601,500 | 2/1997 | Shipley | 473/340 |

*Primary Examiner*—Sebastiano Passaniti
*Attorney, Agent, or Firm*—Iandiorio & Teska

[57] ABSTRACT

A golf club is provided in which a face 14 is formed so as to incline to become more distant from an axis L1 of a club shaft 11 as the face 14 extends from upper to lower, and an angle q1 formed by the axis L1 and the face 14, in an imaginary plane which is perpendicular to the face 14 and includes the axis L1 of the club shaft, is selected to be in a range from 0.3 to 45.0 degrees. With this constitution, the influence of the undulation of ground to a golf ball 90 is reduced which enabling the golf ball 90 to reach a target position.

6 Claims, 4 Drawing Sheets

GOLF CLUB

BACKGROUND OF THE INVENTION

1. Field of the Invention

The present invention relates to a golf club for hitting a golf ball in a golf play.

2. Description of the Related Art

For the purpose of hitting a golf ball far ahead, a face of golf club is generally designed to incline with respect to a club shaft so as to more approach the axis of the club shaft as the face extends from upper to lower. More specifically, the upper end of the face is more spaced from the axis of the club shaft than the lower end. The inclination angle of the face between the axis of the club shaft is called a loft and determined depending on the type and purpose of the golf club. For example, the loft of a number-one wood club or a driver is about 11 degrees, the loft of a number-three iron club is about 23 degrees, and the loft of a putter is about 2 degrees with no need of hitting the golf ball far.

When the golf ball is hit by a conventional golf club, particularly, by a putter having a loft of about 2 degrees as described above, the ball may take off from the ground immediately after the hitting and may be largely affected by undulation of the ground where the golf ball is to be grounded, which makes it difficult to allow the golf ball to reach a target position.

SUMMARY OF THE INVENTION

It is an object of the present invention to provide a golf club capable of reducing the influence of undulation of the ground and allowing a golf ball to reach the target position easily.

The present invention provides a golf club comprising a face formed so as to incline to become more distant from an axis of a club shaft as the face extends from upper to lower, wherein an angle q1 formed by the axis of the club shaft and the face, in an imaginary plane which is perpendicular to the face and includes the axis of the club shaft, is selected to be in a range from 0.3 to 45.0 degrees. That is, the angle q1 exists in a negative (minus) range, when a loft of the prior art golf club is defined to be positive (plus).

According to the invention, since the face of the golf club is formed so as to incline to become more distant from the axis of the club shaft as the face extends from upper to lower, and the angle q1 formed by the axis of the club shaft and the face in the imaginary plane which is perpendicular to the face and includes the axis of the club shaft is selected to be in the range from 0.3 to 45.0 degrees, it is possible in hitting a golf ball to hit a periphery of the golf ball at a point above a horizontal plane which extends across the center of the golf ball, and further to apply an impact to the golf ball in the downwardly inclining forward direction with respect to the golf ball.

The present invention provides a golf club comprising a face formed so as to incline to become more distant from an axis of a club shaft as the face extends from upper to lower, wherein an angle q1 formed by the axis of the club shaft and the face, in an imaginary plane which is perpendicular to the face and includes the axis of the club shaft, is selected to be in a range from 0.3 to 30.0 degrees. That is, the angle q1 exists in a negative (minus) range, when a loft of the prior art golf club is defined to be positive (plus).

According to the invention, since the face of the golf club is formed so as to incline to become more distant from the axis of the club shaft as the face extends from upper to lower, and the angle q1 formed by the axis of the club shaft and the face in the imaginary plane which is perpendicular to the face and includes the axis of the club shaft is selected to be in the range from 0.3 to 30.0 degrees, it is possible in hitting a golf ball to hit a periphery of the golf ball at a point above a horizontal plane which extends across the center of the golf ball, and further to apply an impact to the golf ball in the downwardly inclining forward direction with respect to the golf ball.

The present invention provides a golf club comprising a face formed so as to incline to become more distant from an axis of a club shaft as the face extends from upper to lower, wherein an angle q1 formed by the axis of the club shaft and the face, in an imaginary plane which is perpendicular to the face and includes the axis of the club shaft, is selected to be in a range from 0.3 to 15.0 degrees. That is, the angle q1 exists in a negative (minus) range, when a loft of the prior art golf club is defined to be positive (plus).

According to the invention, since the face of the golf club is formed so as to incline to become more distant from the axis of the club shaft as the face extends from upper to lower, and the angle q1 formed by the axis of the club shaft and the face in the imaginary plane which is perpendicular to the face and includes the axis of the club shaft is selected to be in the range from 0.3 to 15.0 degrees, it is possible in hitting a golf ball to hit a periphery of the golf ball at a point above a horizontal plane which extends across the center of the golf ball, and further to apply an impact to the golf ball in the downwardly inclining forward direction with respect to the golf ball.

The present invention provides a golf club comprising a face formed so as to incline to become more distant from an axis of a club shaft as the face extends from upper to lower, wherein an angle q1 formed by the axis of the club shaft and the face, in an imaginary plane which is perpendicular to the face and includes the axis of the club shaft, is selected to be in a range from 0.3 to 8.0 degrees. That is, the angle q) 1 exists in a negative (minus) range, when a loft of the prior art golf club is defined to be positive (plus).

According to the invention, since the face of the golf club is formed so as to incline to become more distant from the axis of the club shaft as the face extends from upper to lower, and the angle q1 formed by the axis of the club shaft and the face in the imaginary plane which is perpendicular to the face and includes the axis of the club shaft is selected to be in the range from 0.3 to 8.0 degrees, it is possible in hitting a golf ball to hit a periphery of the golf ball at a point above a horizontal plane which extends across the center of the golf ball, and further to apply an impact to the golf ball in the downwardly inclining forward direction with respect to the golf ball.

The present invention provides a golf club comprising a face formed so as to incline to become more distant from an axis of a club shaft as the face extends from upper to lower, wherein an angle q1 formed by the axis of the club shaft and the face, in an imaginary plane which is perpendicular to the face and includes the axis of the club shaft, is selected to be in a range from 8.01 to 15.0 degrees. That is, the angle q1 exists in a negative (minus) range, when a loft of the prior art golf club is defined to be positive (plus).

According to the invention, since the face of the golf club is formed so as to incline to become more distant from the axis of the club shaft as the face extends from upper to lower, and the angle q1 formed by the axis of the club shaft and the face in the imaginary plane which is perpendicular to the face and includes the axis of the club shaft is selected to be in the range from 8.01 to 15.0 degrees, it is possible in hitting a golf ball to hit a periphery of the golf ball at a point above a horizontal plane which extends across the center of the golf ball, and further to apply an impact to the golf ball in the downwardly inclining forward direction with respect to the golf ball.

The present invention provides a golf club comprising a face formed so as to incline to become more distant from an axis of a club shaft as the face extends from upper to lower, wherein an angle q1 formed by the axis of the club shaft and the face, in an imaginary plane which is perpendicular to the face and includes the axis of the club shaft, is selected to be in a range from 0.3 to 4.0 degrees. That is, the angle q1 exists in a negative (minus) range, when a loft of the prior art golf club is defined to be positive (plus).

According to the invention, since the face of the golf club is formed so as to incline to become more distant from the axis of the club shaft as the face extends from upper to lower, and the angle q1 formed by the axis of the club shaft and the face in the imaginary plane which is perpendicular to the face and includes the axis of the club shaft is selected to be in the range from 0.3 to 4.0 degrees, it is possible in hitting a golf ball to hit a periphery of the golf ball at a point above a horizontal plane which extends across the center of the golf ball, and further to apply an impact to the golf ball in the downwardly inclining forward direction with respect to the golf ball.

The present invention provides a golf club comprising a face formed so as to incline to become more distant from an axis of a club shaft as the face extends from upper to lower, wherein an angle q1 formed by the axis of the club shaft and the face, in an imaginary plane which is perpendicular to the face and includes the axis of the club shaft, is selected to be in a range from 4.01 to 8.0 degrees. That is, the angle q1 exists in a negative (minus) range, when a loft of the prior art golf club is defined to be positive (plus).

According to the invention, since the face of the golf club is formed so as to incline to become more distant from the axis of the club shaft as the face extends from upper to lower, and the angle q1 formed by the axis of the club shaft and the face in the imaginary plane which is perpendicular to the face and includes the axis of the club shaft is selected to be in the range from 4.01 to 8.0 degrees, it is possible in hitting a golf ball to hit a periphery of the golf ball at a point above a horizontal plane which extends across the center of the golf ball, and further to apply an impact to the golf ball in the downwardly inclining forward direction with respect to the golf ball.

The present invention provides a golf club comprising a face formed so as to incline to become more distant from an axis of a club shaft as the face extends from upper to lower, wherein an angle q1 formed by the axis of the club shaft and the face, in an imaginary plane which is perpendicular to the face and includes the axis of the club shaft, is selected to be in a range from 8.01 to 10.0 degrees. That is, the angle q1 exists in a negative (minus) range, when a loft of the prior art golf club is defined to be positive (plus).

According to the invention, since the face of the golf club is formed so as to incline to become more distant from the axis of the club shaft as the face extends from upper to lower, and the angle q1 formed by the axis of the club shaft and the face in the imaginary plane which is perpendicular to the face and includes the axis of the club shaft is selected to be in the range from 8.01 to 10.0 degrees, it is possible in hitting a golf ball to hit a periphery of the golf ball at a point above a horizontal plane which extends across the center of the golf ball, and further to apply an impact to the golf ball in the downwardly inclining forward direction with respect to the golf ball.

The invention provides a golf club comprising a putter head including a face for hitting a golf ball and a sole region formed in connection with a lower end of the face, wherein the sole region is formed so as to be set back from the face to become more distant from an axis of a club shaft, and an interface between the face and the sole region has a curved sectional profile in an imaginary plane which is perpendicular to the face and includes the axis of the club shaft.

According to the invention, since a putter head includes a face for hitting a golf ball and a sole region is formed in connection with a lower end of the face so as to be set back from the face to become more distant from an axis of a club shaft, the sole region will not contact with a golf ball, which enabling the face to hit the golf ball at a point above a horizontal plane which extends across the center of the golf ball on a periphery of the same. Furthermore, since the interface between the face and the sole region has a curved sectional profile in the imaginary plane which is perpendicular to the face and includes the axis of the club shaft, there is no possibility of damaging the golf ball in hitting the golf ball and of injuring player's fingers and hands during the handle of the golf club.

Still further, the invention provides a golf club comprising a putter head including a face for hitting a golf ball and a sole region formed in connection with a lower end of the face, wherein the face is formed so as to incline to become more distant from an axis of a club shaft as the face extends from upper to lower, an angle q1 formed by the axis of the club shaft and the face, in an imaginary plane which is perpendicular to the face and includes the axis of the club shaft, is selected to be in a range from 0.3 to 45.0 degrees, the sole region is formed so as to be set back from the face to become more distant from an axis of a club shaft, and an interface between the face and the sole region has a curved sectional profile in an imaginary plane which is perpendicular to the face and includes the axis of the club shaft. That is, the angle q1 belongs in negative (minus) range, when the loft of the conventional golf club is defined as positive (plus) range.

According to the invention, since a putter head includes a face and a sole region, the sole region being formed in connection with the lower end of the face, the face being formed so as to incline to become more distant from an axis of a club shaft as the face extends from upper to lower, and the angle q1 formed by the axis of the club shaft and the face in the imaginary plane which is perpendicular to the face and includes the axis of the club shaft is selected to be in the range from 0.3 to 45.0 degrees, it is possible in hitting a golf ball to hit a periphery of the golf ball at a point above a horizontal plane which extends across the center of the golf ball, and further to apply an impact to the golf ball in the downwardly inclining forward direction with respect to the golf ball. Furthermore, since the sole region is formed so as to be set back from the face to become more distant from an axis of a club shaft, the sole region will not contact with a golf ball, which enabling the face to hit the golf ball at a point above a horizontal plane which extends across the center of the golf ball on a periphery of the same. Still further, since the interface between the face and the sole region has a curved sectional profile in the imaginary plane which is perpendicular to the face and includes the axis of the club shaft, there is no possibility of damaging the golf ball in hitting the golf ball and of injuring player's fingers and hands during the handle of the golf club.

Still further, the invention provides a golf club comprising a putter head including a face for hitting a golf ball and a sole region formed in connection with a lower end of the face, wherein the face is formed so as to incline to become more distant from an axis of a club shaft as the face extends from upper to lower, an angle q1 formed by the axis of the club shaft and the face, in an imaginary plane which is perpendicular to the face and includes the axis of the club shaft, is selected to be in a range from 0.3 to 30.0 degrees, the sole region is formed so as to be set back from the face to become more distant from an axis of a club shaft, and an interface between the face and the sole region has a curved sectional profile in an imaginary plane which is perpendicular to the face and includes the axis of the club shaft. That is, the angle q1 belongs in negative (minus) range, when the loft of the conventional golf club is defined as positive (plus) range.

According to the invention, since a putter head includes a face and a sole region, the sole region being formed in connection with the lower end of the face, the face being formed so as to incline to become more distant from an axis of a club shaft as the face extends from upper to lower, and the angle q1 formed by the axis of the club shaft and the face in the imaginary plane which is perpendicular to the face and includes the axis of the club shaft is selected to be in the range from 0.3 to 30.0 degrees, it is possible in hitting a golf ball to hit a periphery of the golf ball at a point above a horizontal plane which extends across the center of the golf ball, and further to apply an impact to the golf ball in the downwardly inclining forward direction with respect to the golf ball. Furthermore, since the sole region is formed so as to be set back from the face to become more distant from an axis of a club shaft, the sole region will not contact with a golf ball, which enabling the face to hit the golf ball at a point above a horizontal plane which extends across the center of the golf ball on a periphery of the same. Still further, since the interface between the face and the sole region has a curved sectional profile in the imaginary plane which is perpendicular to the face and includes the axis of the club shaft, there is no possibility of damaging the golf ball in hitting the golf ball and of injuring player's fingers and hands during the handle of the golf club.

Still further, the invention provides a golf club comprising a putter head including a face for hitting a golf ball and a sole region formed in connection with a lower end of the face, wherein the face is formed so as to incline to become more distant from an axis of a club shaft as the face extends from upper to lower, an angle q1 formed by the axis of the club shaft and the face, in an imaginary plane which is perpendicular to the face and includes the axis of the club shaft, is selected to be in a range from 0.3 to 15.0 degrees, the sole region is formed so as to be set back from the facthe sole region is formed so as to be set back from the face to become more distant from an axis of a club shaft, and an interface between the face and the sole region has a curved sectional profile in an imaginary plane which is perpendicular to the face and includes the axis of the club shaft. That is, the angle q1 belongs in negative (minus) range, when the loft of the conventional golf club is defined as positive (plus) range.

According to the invention, since a putter head includes a face and a sole region, the sole region being formed in connection with the lower end of the face, the face being formed so as to incline to become more distant from an axis of a club shaft as the face extends from upper to lower, and the angle q1 formed by the axis of the club shaft and the face in the imaginary plane which is perpendicular to the face and includes the axis of the club shaft is selected to be in the range from 0.3 to 15.0 degrees, it is possible in hitting a golf ball to hit a periphery of the golf ball at a point above a horizontal plane which extends across the center of the golf ball, and further to apply an impact to the golf ball in the downwardly inclining forward direction with respect to the golf ball. Furthermore, since the sole region is formed so as to be set back from the face to become more distant from an axis of a club shaft, the sole region will not contact with a golf ball, which enabling the face to hit the golf ball at a point above a horizontal plane which extends across the center of the golf ball on a periphery of the same. Still further, since the interface between the face and the sole region has a curved sectional profile in the imaginary plane which is perpendicular to the face and includes the axis of the club shaft, there is no possibility of damaging the golf ball in hitting the golf ball and of injuring player's fingers and hands during the handle of the golf club.

Still further, the invention provides a golf club comprising a putter head including a face for hitting a golf ball and a sole region formed in connection with a lower end of the face, wherein the face is formed so as to incline to become more distant from an axis of a club shaft as the face extends from upper to lower, an angle q1 formed by the axis of the club shaft and the face, in an imaginary plane which is perpendicular to the face and includes the axis of the club shaft, is selected to be in a range from 0.3 to 8.0 degrees, the sole region is formed so as to be set back from the face to become more distant from an axis of a club shaft, and an interface between the face and the sole region has a curved sectional profile in an imaginary plane which is perpendicular to the face and includes the axis of the club shaft. That is, the angle q1 belongs in negative (minus) range, when the loft of the conventional golf club is defined as positive (plus) range.

According to the invention, since a putter head includes a face and a sole region, the sole region being formed in connection with the lower end of the face, the face being formed so as to incline to become more distant from an axis of a club shaft as the face extends from upper to lower , and the angle q1 formed by the axis of the club shaft and the face in the imaginary plane which is perpendicular to the face and includes the axis of the club shaft is selected to be in the range from 0.3 to 8.0 degrees, it is possible in hitting a golf ball to hit a periphery of the golf ball at a point above a horizontal plane which extends across the center of the golf ball, and further to apply an impact to the golf ball in the downwardly inclining forward direction with respect to the golf ball. Furthermore, since the sole region is formed so as to be set back from the face to become more distant from an axis of a club shaft, the sole region will not contact with a golf ball, which enabling the face to hit the golf ball at a point above a horizontal plane which extends across the center of the golf ball on a periphery of the same. Still further, since the interface between the face and the sole region has a curved sectional profile in the imaginary plane which is perpendicular to the face and includes the axis of the club shaft, there is no possibility of damaging the golf ball in hitting the golf ball and of injuring player's fingers and hands during the handle of the golf club.

Still further, the invention provides a golf club comprising a putter head including a face for hitting a golf ball and a sole region formed in connection with a lower end of the face, wherein the face is formed so as to incline to become more distant from an axis of a club shaft as the face extends from upper to lower, an angle q1 formed by the axis of the club shaft and the face, in an imaginary plane which is perpendicular to the face and includes the axis of the club shaft, is selected to be in a range from 8.01 to 15.0 degrees, the sole region is formed so as to be set back from the face to become more distant from an axis of a club shaft, and an interface between the face and the sole region has a curved sectional profile in an imaginary plane which is perpendicular to the face and includes the axis of the club shaft. That is, the angle q1 belongs in negative (minus) range, when the loft of the conventional golf club is defined as positive (plus) range.

According to the invention, since a putter head includes a face and a sole region, the sole region being formed in connection with the lower end of the face, the face being formed so as to incline to become more distant from an axis of a club shaft as the face extends from upper to lower, and the angle q1 formed by the axis of the club shaft and the face in the imaginary plane which is perpendicular to the face and includes the axis of the club shaft is selected to be in the range from 8.01 to 15.0 degrees, it is possible in hitting a golf ball to hit a periphery of the golf ball at a point above a horizontal plane which extends across the center of the golf ball, and further to apply an impact to the golf ball in the downwardly inclining forward direction with respect to the golf ball. Furthermore, since the sole region is formed so as to be set back from the face to become more distant from an axis of a club shaft, the sole region will not contact with a golf ball, which enabling the face to hit the golf ball at a point above a horizontal plane which extends across the center of the golf ball on a periphery of the same. Still further, since the interface between the face and the sole region has a curved sectional profile in the imaginary plane which is perpendicular to the face and includes the axis of the club shaft, there is no possibility of damaging the golf ball in hitting the golf ball and of injuring player's fingers and hands during the handle of the golf club.

Still further, the invention provides a golf club comprising a putter head including a face for hitting a golf ball and a sole region formed in connection with a lower end of the face, wherein the face is formed so as to incline to become more distant from an axis of a club shaft as the face extends from upper to lower, an angle q1 formed by the axis of the club shaft and the face, in an imaginary plane which is perpendicular to the face and includes the axis of the club shaft, is selected to be in a range from 0.3 to 4.0 degrees, the sole region is formed so as to be set back from the face to become more distant from an axis of a club shaft, and an interface between the face and the sole region has a curved sectional profile in an imaginary plane which is perpendicular to the face and includes the axis of the club shaft. That is, the angle q1 belongs in negative (minus) range, when the loft of the conventional golf club is defined as positive (plus) range.

According to the invention, since a putter head includes a face and a sole region, the sole region being formed in connection with the lower end of the face, the face being formed so as to incline to become more distant from an axis of a club shaft as the face extends from upper to lower, and the angle q1 formed by the axis of the club shaft and the face in the imaginary plane which is perpendicular to the face and includes the axis of the club shaft is selected to be in the range from 0.3 to 4.0 degrees, it is possible in hitting a golf ball to hit a periphery of the golf ball at a point above a horizontal plane which extends across the center of the golf ball, and further to apply an impact to the golf ball in the downwardly inclining forward direction with respect to the golf ball. Furthermore, since the sole region is formed so as to be set back from the face to become more distant from an axis of a club shaft, the sole region will not contact with a golf ball, which enabling the face to hit the golf ball at a point above a horizontal plane which extends across the center of the golf ball on a periphery of the same. Still further, since the interface between the face and the sole region has a curved sectional profile in the imaginary plane which is perpendicular to the face and includes the axis of the club shaft, there is no possibility of damaging the golf ball in hitting the golf ball and of injuring player's fingers and hands during the handle of the golf club.

Still further, the invention provides a golf club comprising a putter head including a face for hitting a golf ball and a sole region formed in connection with a lower end of the face, wherein the face is formed so as to incline to become more distant from an axis of a club shaft as the face extends from upper to lower, an angle q1 formed by the axis of the club shaft and the face, in an imaginary plane which is perpendicular to the face and includes the axis of the club shaft, is selected to be in a range from 4.01 to 8.0 degrees, the sole region is formed so as to be set back from the face to become more distant from an axis of a club shaft, and an interface between the face and the sole region has a curved sectional profile in an imaginary plane which is perpendicular to the face and includes the axis of the club shaft. That is, the angle q1 belongs in negative (minus) range, when the loft of the conventional golf club is defined as positive (plus) range.

According to the invention, since a putter head includes a face and a sole region, the sole region being formed in connection with the lower end of the face, the face being formed so as to incline to become more distant from an axis of a club shaft as the face extends from upper to lower, and the angle q1 formed by the axis of the club shaft and the face in the imaginary plane which is perpendicular to the face and includes the axis of the club shaft is selected to be in the range from 4.01 to 8.0 degrees, it is possible in hitting a golf ball to hit a periphery of the golf ball at a point above a horizontal plane which extends across the center of the golf ball, and further to apply an impact to the golf ball in the downwardly inclining forward direction with respect to the golf ball. Furthermore, since the sole region is formed so as to be set back from the face to become more distant from an axis of a club shaft, the sole region will not contact with a golf ball, which enabling the face to hit the golf ball at a point above a horizontal plane which extends across the center of the golf ball on a periphery of the same. Still further, since the interface between the face and the sole region has a curved sectional profile in the imaginary plane which is perpendicular to the face and includes the axis of the club shaft, there is no possibility of damaging the golf ball in hitting the golf ball and of injuring player's fingers and hands during the handle of the golf club.

Still further, the invention provides a golf club comprising a putter head including a face for hitting a golf ball and a sole region formed in connection with a lower end of the face, wherein the face is formed so as to incline to become more distant from an axis of a club shaft as the face extends from upper to lower, an angle q1 formed by the axis of the club shaft and the face, in an imaginary plane which is perpendicular to the face and includes the axis of the club shaft, is selected to be in a range from 8.01 to 10.0 degrees, the sole region is formed so as to be set back from the face to become more distant from an axis of a club shaft, and an interface between the face and the sole region has a curved sectional profile in an imaginary plane which is perpendicular to the face and includes the axis of the club shaft. That is, the angle q1 belongs in negative (minus) range, when the loft of the conventional golf club is defined as positive (plus) range.

According to the invention, since a putter head includes a face and a sole region, the sole region being formed in connection with the lower end of the face, the face being formed so as to incline to become more distant from an axis of a club shaft as the face extends from upper to lower , and the angle q1 formed by the axis of the club shaft and the face in the imaginary plane which is perpendicular to the face and includes the axis of the club shaft is selected to be in the range from 8.01 to 10.0 degrees, it is possible in hitting a golf ball to hit a periphery of the golf ball at a point above a horizontal plane which extends across the center of the golf ball, and further to apply an impact to the golf ball in the downwardly inclining forward direction with respect to the golf ball. Furthermore, since the sole region is formed so as to be set back from the face to become more distant from an axis of a club shaft, the sole region will not contact with a golf ball, which enabling the face to hit the golf ball at a point above a horizontal plane which extends across the center of the golf ball on a periphery of the same. Still further, since the interface between the face and the sole region has a curved sectional profile in the imaginary plane which is perpendicular to the face and includes the axis of the club shaft, there is no possibility of damaging the golf ball in hitting the golf ball and of injuring player's fingers and hands during the handle of the golf club.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
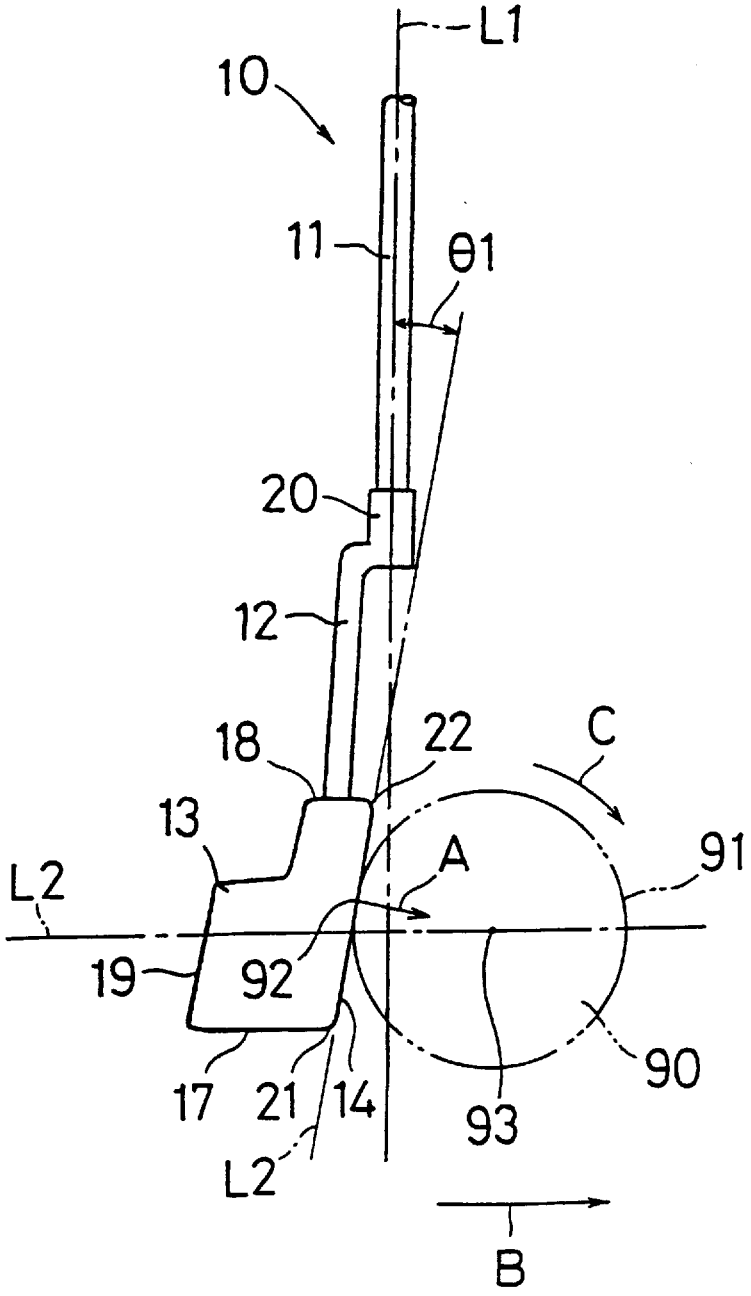
FIG. 1 is a side view showing a part of a golf club 10 of an embodiment of the present invention.

Now referring to the drawings, preferred embodiments of the invention are described below.

Figure 2:
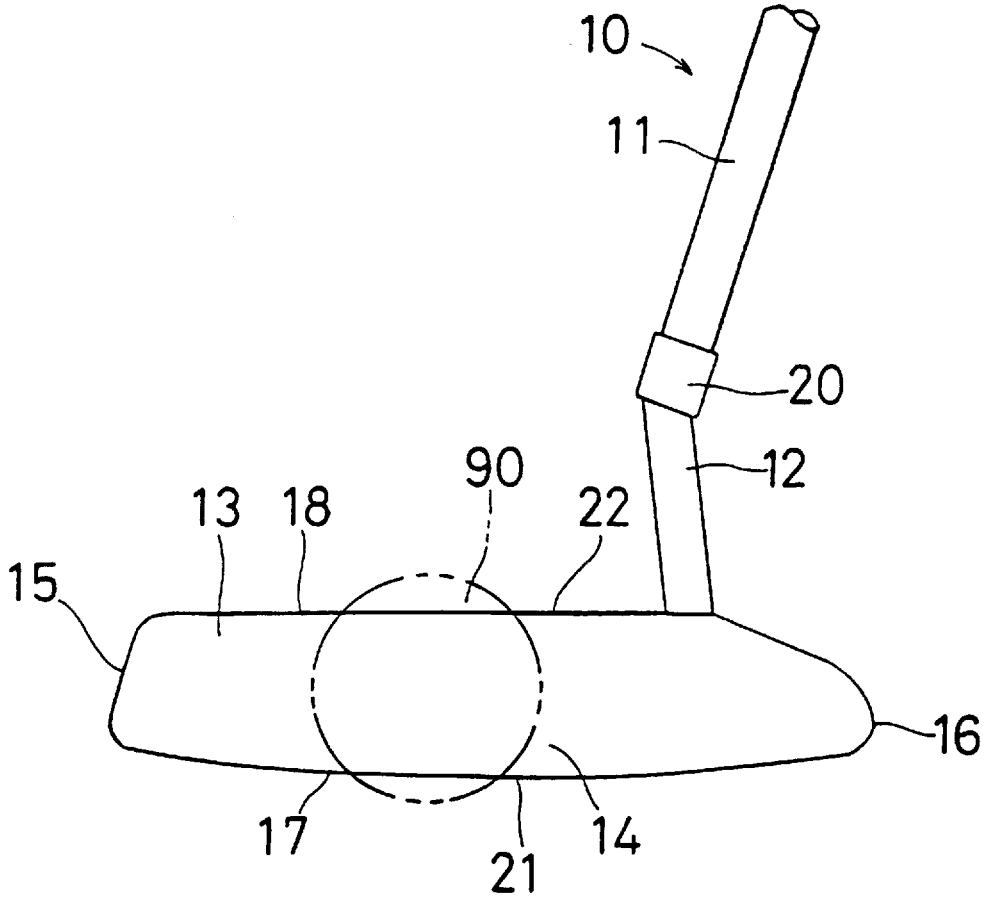
FIG. 2 is a front view of a putter head 13 of the golf club 10.

FIG. 1 is a side view showing a part of a golf club 10 of an embodiment of the present invention and FIG. 2 is a front view of a putter head 13 of the golf club 10.

The golf club defined in this specification represents any device or means designed for hitting a golf ball in a golf play or a golf practice and is selected from golf putters, wooden clubs such as a driver, and irons such as a sand wedge.

The golf club 10 comprises a club shaft 11 of straight shape made of steel or carbon fiber, the club shaft being provided with a grip (not shown) to be gripped by a player at the upper end thereof, and a metallic putter head 13 fixed to the lower end of the club shaft 11 via a metallic hosel 12.

The putter head 13 comprises a flat face 14 which comes into contact with a golf ball 90 denoted by the imaginary line in FIG. 1 in hitting of the golf ball 90, a toe 15 provided at the front face thereof, a heel 17 provided at a back face thereof, a sole 17 provided at a bottom face thereof, a top 18 provided at the upper face thereof, and a backface 19 provided at a rear face side of the face 14.

The golf club 10 is used for hitting the golf ball 90 with its face 14 contacting with the golf ball 90 to reach the golf ball 90 to the target position or more particularly, to a hole cup on a green of a golf course.

The face 14 is formed so as to incline to become more distant from an axis L1 of the club shaft 11, that is, incline leftward in FIG. 1 as the face extends from upper to lower, namely from upper to lower in FIG. 1. And also, an angle q1 formed by the axis L1 of the club shaft 11 and the face 14 in an imaginary plane which is perpendicular to the face 14 and includes the axis L1 of the club shaft 11 is selected to be in a range from 0.3 to 45.0 degrees. In other words, in contrast with the conventional golf club in which a loft is formed so that a face tilts in approaching direction to an axis of a club shaft as the face extends from upper to lower, the face 14 of the golf club 10 of the present invention is formed so as to incline to become more distant from the axis L1 of the club shaft 11 as the face extends from upper to lower. When the inclination degree of the loft of the conventional golf club is defined to positive (plus), the inclination degree of the face 14 of the golf club 10 of this embodiment falls to negative (minus).

The hosel 12 is formed so as to extend from the top 18 at the vicinity of the heel 16 and to be bent into the face 14 side at the upper end thereof. The club shaft 11 is fixed to an upper part 20 of the hosel 12. The shape of the hosel 12 may be determined depending on the shape of the putter head 13 or the player's taste. Although the shape of the hosel 12 in this embodiment is bent at the upper end as described above, it may be straight for other embodiments. The hosel 12 is preferably shaped to meet applicable rules of golf but its shape may be determined according to user's taste of the golf club 10 in considering change in the rules.

Since the face 14 is formed so as to incline to become more distant from the axis L1 of the club shaft 11 as the face extends from upper to lower, when hitting the golf ball 90, an impact can be applied to the golf ball 90 into a direction denoted by an allow A (hereinafter, referred to "downwardly inclining forward direction). More particularly, the golf ball 90 receives the impact on an contact face 92 of an outer periphery 91 thereof with the face 14, along a traveling direction B into the direction inclining downwardly from the contact surface 92 side to a center 93 side. As a result of this, the golf ball 90 travels along the traveling direction B while forwardly rotating in a direction denoted by an allow C. In this context, "forward rotation" means such a rotation that a given point on the outer periphery 91 of the golf ball 90 which is located on an imaginary plane which extends perpendicular to the ground and across the center 93 of the golf ball 90 moves from upstream to downstream in an area locating upper half of the outer periphery 91.

Since the golf ball 90 runs along the traveling direction B while rotating forwardly, the golf ball 90 goes flying extendedly so that it can reach a target position or a hole cup without being so affected by the undulation of ground. Also, as the golf ball 90 receives the impact along the traveling direction B into the direction which inclines downwardly from the contact surface 92 side towards the center 93 side, the golf ball 90 starts rotating as is pushed against the ground. Accordingly, the golf ball 90 will not rotate apart from the ground but rotates and moves while closely contacting with the ground, so that it is possible to reach the golf ball 90 to the target position or hole cup without so affected by the undulation of ground.

The angle q1 may be appropriately selected by considering undulations and conditions of the ground at the time of using the golf club 10. The ground termed in this specification covers all surfaces, where the golf ball 90 lies, including greens, fairways, and roughs.

In the case where turf of the green has been shortly trimmed, for example, application of strong impact to the golf ball 90 in the downwardly inclining forward direction is needed and so the angle q1 is selected to be in a range from 20.0 to 45.0 degrees. In contrast, when the turf is long, there is no need of applying a strong impact to the golf ball 90 in the downwardly inclining forward direction, the angle q1 is selected to be in a range from 0.3 to 20.0 degrees. Also, when the turf is soaked with water due to rain or the like, there is no need of applying a strong impact to the golf ball 90 in the downwardly inclining forward direction and so the angle q1 is selected to be in a range from 0.3 to 15.0 degrees. When the green is dried and has a sufficient elasticity after a series of sunny days, application of strong impact on the golf ball 90 in the downwardly inclining forward direction is needed and the angle q1 is selected to be in a range from 30.0 to 45.0 degrees.

As described above, though the angle q1 in this embodiment is selected to be in a range from 0.3 to 45.0 degrees, the angle q1 is may be appropriately selected, depending on undulations and conditions of the ground at the time of using the golf club 10 is used, within a ranges from 0.3 to 30 degrees, from 0.3 to 15.0 degrees, from 0.3 to 8.0 degrees, from 8.01 to 15.0 degrees, 0.3 to 4.0 degrees, 4.01 to 8.0 degrees, and 8.01 to 10.0 degrees.

As described above, the putter head 13 is provided with the toe 15 at its front surface, the heel 16 at its back surface, the sole 17 at its bottom surface , and the top 18 at its upper surface, and the backface is provided at the rear surface of the face 14. A reading edge 21 is provided at the connection portion between the face 14 and the sole 17, and a top edge 22 is provided at the connection portion between the face 14 and the top 18.

Both the leading edge 21 and the top edge 22 have curved sectional profiles. Since the sectional profile of the leading edge 21 is designed to be curved, the golf ball 90 is prevented from being damaged on the outer surface 91 when it is hit. This allows the golf ball 90 to be repeatedly used for a considerable length of time. Similarly, since the top edge 22 is formed so as to have a curved sectional profile the user will not be injured his hand or finger when handling the golf club 10 such as in cleaning and repairing.

The toe 15 and the heel 16 are formed in connection with the face 14, the sole 17, the top 18, and the backface 19, and each edge potion between any two adjacent parts of the face 14, the sole 17, the top 18, the backface 19, the toe 15, and the heel 16 is formed so as to have a curved sectional profile. Therefore, the user will not be injured his hand or finger when handling the golf club 10 such as in cleaning and repairing.

Figure 3:
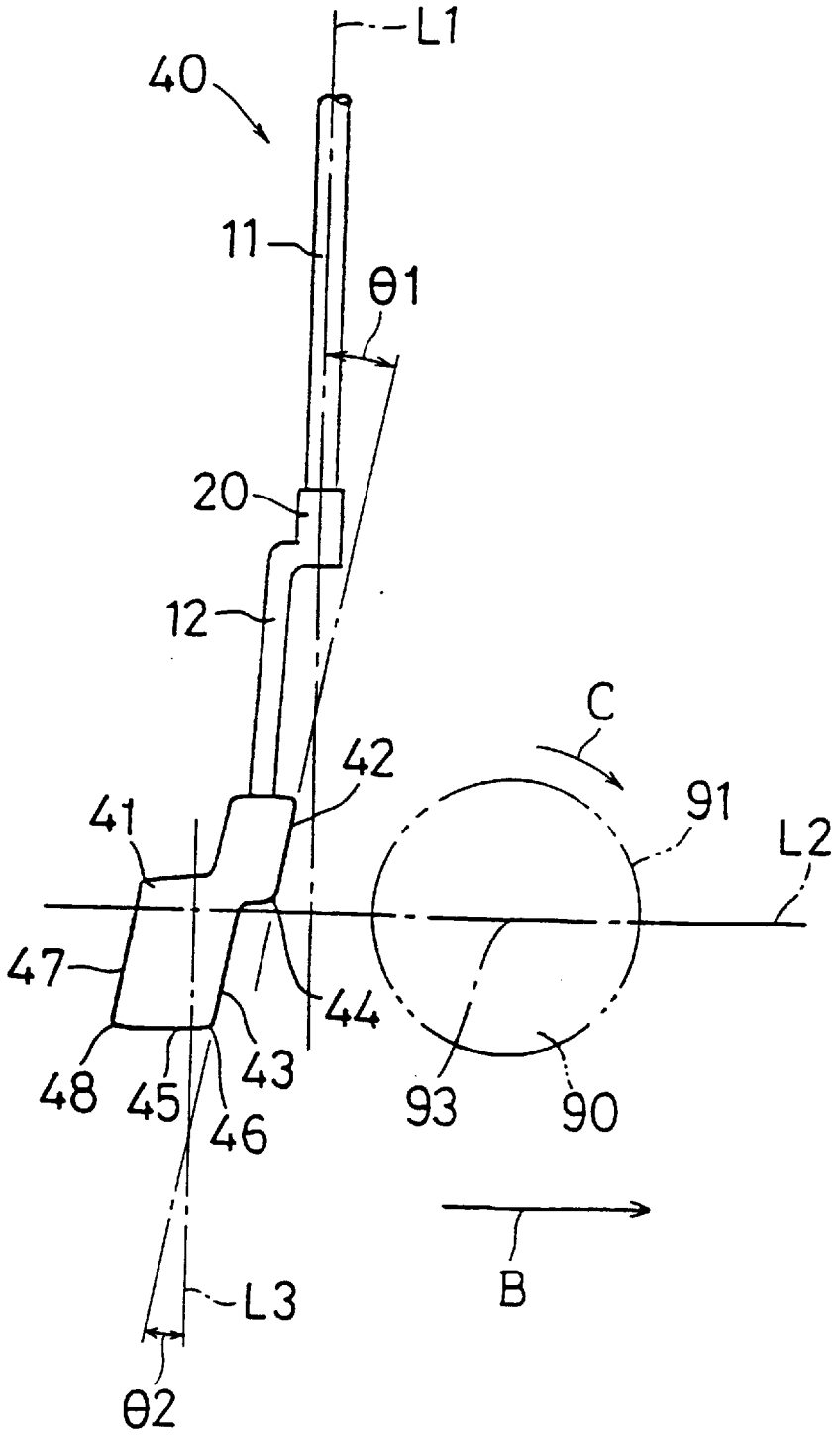
FIG. 3 is a side view showing a part of a golf club 40 of another embodiment of the present invention.

FIG. 3 is a side view showing a part of a golf club 40 of another embodiment of the invention. The golf club 40 of this embodiment is similar in construction to the golf club 10 and will be explained by denoting similar components by the same numerals.

The structures of a grip (not shown), a club shaft 11, and a hosel 12 constituting the golf club 40 are similar to those of the golf club 10.

A putter head 41 comprises a face 42 for hitting the golf ball 90 and a sole region 43 formed continuously from the lower end of the face 42.

The sole region 43 is formed so as to be set back from the face 42 to become more distant from an axis L1 of a club shaft 11. In other words, the sole region 43 is formed so as to be located closer to the rear side of the putter head 41 than the face 42. The face 42 is formed so as to incline to become more distant from the axis L1 of the club shaft 11, that is, incline leftward in FIG. 3 as the face extends from upper to lower. And also, the angle q1 formed by the axis L1 of the club shaft 11 and the face 42 in an imaginary plane which is perpendicular to the face 42 and includes the axis L1 of the club shaft 11 is selected to be in a range from 0.3 to 45.0 degrees.

The sole region 43 has only to be formed so as to be set back from the face 42 to become more distant from an axis L1 of a club shaft 11, and the sole region 43 may be approximately in parallel with the axis L1 of the club shaft 11 or may be formed so as to incline to become more distant from the axis L1 of the club shaft 11 from upside to downside in FIG. 3, that is, inclined leftward in FIG. 3. In this embodiment, the sole region 43 is formed extending from upper to lower so as to be incline to become more distant from the axis L1 of the club shaft 11 from upside to downside in FIG. 3, wherein an angle q2 formed by the sole region 43 and an imaginary line L3 parallel with the axis L1 of the club shaft 11 in an imaginary plane which is perpendicular to the sole region 43 and includes the axis L1 of the club shaft 11 is set to 10 degrees.

An interface 44 between the face 42 and the sole region 43 has a curved sectional profile in an imaginary plane which is perpendicular to the face 42 and includes the axis L1 of the club shaft 11. This prevents the periphery 91 of the golf ball 90 from being damaged by the interface 44 in hitting of the golf ball 90. This allows the golf ball 90 to be used repeatedly used for a considerable length of time.

A leading edge 46 where the sole region 43 and the sole 45 are connecting, and a region 48 where the sole 45 and the back face 47 are connecting are formed so as to have a curved sectional profile. The section profile of the leading edge 46 and the region 48 are formed not having acute angles, which preventing the player from being injured on his or her fingers and hands during handling of the golf club, for example in cleaning or repairing the golf club 40.

The interface 44 is located above a horizontal plane L2 which extends across the center 93 of the golf ball 90, hence allowing the periphery 91 of the golf ball 90 to be impacted at a point above the horizontal plane L2 which extends across the center 93 of the golf ball 90. When hitting the golf ball 90 with the golf club 40, the periphery 91 is impacted by the interface 44 at the point above the horizontal plane L2 which extends across the center 93 of the golf ball 90, so that the golf ball 90 runs along the traveling direction B thereof while forwardly rotating in a direction denoted by the arrow C. Owing to the forward rotation thus applied the golf ball 90 goes extendedly flying so that it can reach target point or the hole cup without being so affected by the ground undulations.

The angle q1 may be appropriately selected by considering undulations and conditions of the ground at the time of using the golf club 40. The ground termed in this specification covers all surfaces, where the golf ball 90 lies, including greens, fairways, and roughs.

In the case where turf of the green has been shortly trimmed, for example, application of strong impact to the golf ball 90 in the downwardly inclining forward direction is needed and so the angle q1 is selected to be in a range from 20.0 to 45.0 degrees. In contrast, when the turf is long, there is no need of applying a strong impact to the golf ball 90 in the downwardly inclining forward direction, the angle q1 is selected to be in a range from 0.3 to 20.0 degrees. Also, when the turf is soaked with water due to rain or the like, there is no need of applying a strong impact to the golf ball 90 in the downwardly inclining forward direction and so the angle q1 is selected to be in a range from 0.3 to 15.0 degrees. When the green is dried and has a sufficient elasticity after a series of sunny days, application of strong impact on the golf ball 90 in the downwardly inclining forward direction is needed and the angle q1 is selected to be in a range from 30.0 to 45.0 degrees.

As described above, though the angle q1 in this embodiment is selected to be in a range from 0.3 to 45.0 degrees, the angle q1 is may be appropriately selected, depending on undulations and conditions of the ground at the time of using the golf club 10 is used, within a ranges from 0.3 to 30 degrees, from 0.3 to 15.0 degrees, from 0.3 to 8.0 degrees, from 8.01 to 15.0 degrees, 0.3 to 4.0 degrees, 4.01 to 8.0 degrees, and 8.01 to 10.0 degrees.

Figure 4:
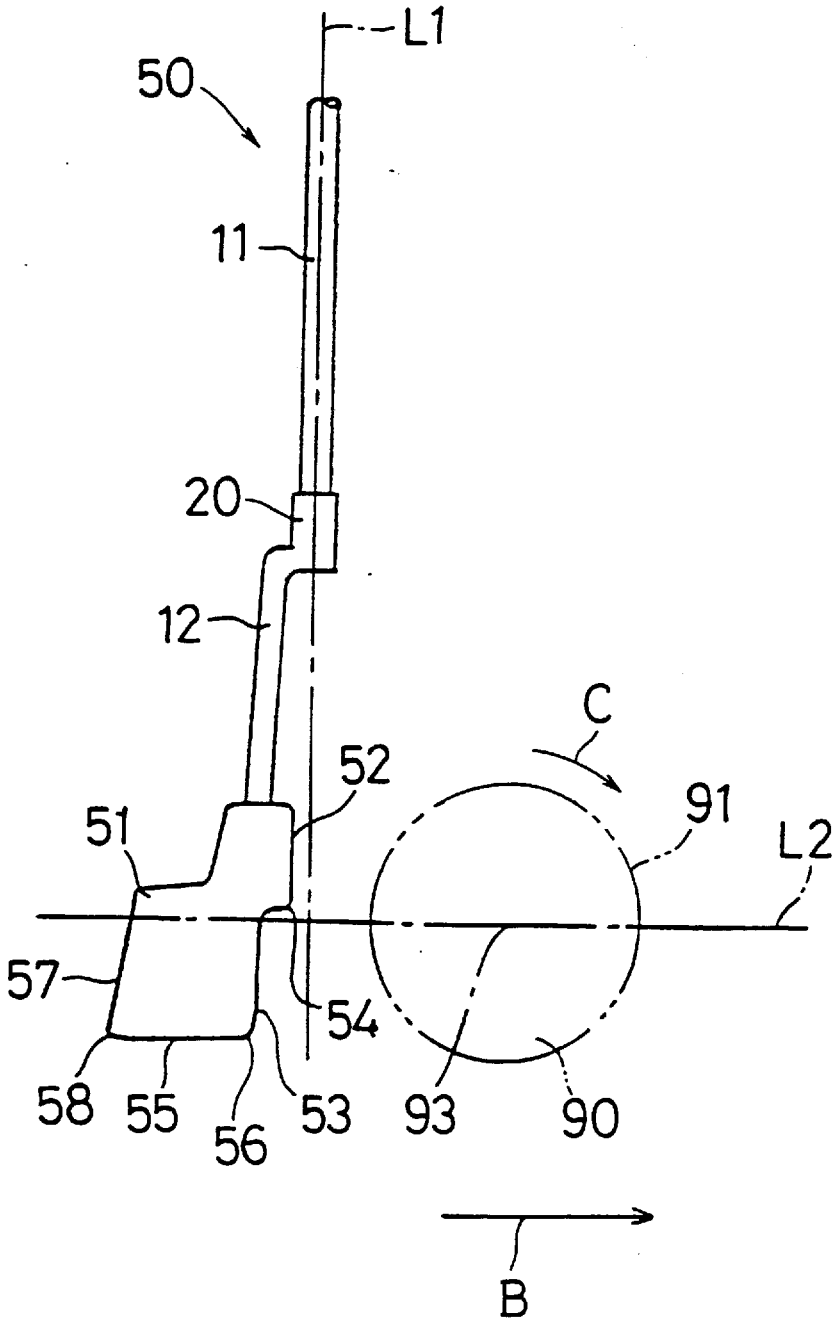
FIG. 4 is a side view showing a part of a golf club 50 of still another embodiment of the present invention.

FIG. 4 is a side view showing a part of a golf club 50 of another embodiment of the invention. The golf club 50 of this embodiment is similar in construction to the golf club 10 and will be explained by denoting similar components by the same numerals.

The structures of a grip (not shown), a club shaft 11, and a hosel 12 constituting the golf club 50 are similar to those of the golf club 10.

A putter head 51 comprises a face 52 for hitting the golf ball 90 and a sole region 53 formed continuously from the lower end of the face 52.

The sole region 53 is formed so as to be set back from the face 52 to become more distant from the axis L1 of the club shaft 11. In other words, the sole region 53 is formed so as to be located closer to the rear side of the putter head 51 than the face 51. Accordingly, distance from the axis L1 of the club shaft 11 to the sole region 53 is designed to longer than distance from the axis L1 of the club shaft 11 to the face 52. The face 52 and the sole region 53 are formed to be approximately parallel to the axis L1 of the club shaft.

A interface 54 between the face 52 and the sole region 53 has a curved sectional profile in an imaginary plane which is perpendicular to the face 52 and includes the axis L1 of the club shaft 11. This prevents the periphery 91 of the golf ball 90 from being damaged by the interface 54 in hitting of the golf ball 90.

The interface 54 is located above a horizontal plane L2 which extends across the center 93 of the golf ball 90, hence allowing the periphery 91 of the golf ball 90 to be impacted at a point above the horizontal plane L2 which extends across the center 93 of the golf ball 90. When hitting the golf ball 90 with the golf club 50, the periphery 91 is impacted by the interface 54 at the point above the horizontal plane L2 which extends across the center 93 of the golf ball 90, so that the golf ball 90 runs along the traveling direction B thereof while forwardly rotating in a direction denoted by the arrow C. Owing to the forward rotation thus applied the golf ball 90 goes extendedly flying so that it can reach target point or the hole cup without being so affected by the ground undulations.

A leading edge 56 where the sole region 53 and the sole 55 are connecting, and a region 58 where the sole 55 and the back face 57 are connecting are formed so as to have curved sectional profiles. The sectional profiles of the leading edge 56 and the region 58 are formed not having acute angles, which preventing the player from being injured on his or her fingers and hands during handling of the golf club, for example in cleaning or repairing the golf club 50.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed:

1. A golf club comprising:

a shaft having an axis $L_1$;

a hosel connected to the shaft; and a golf club head connected to the hosel, the golf club head having a face and a sole region, the face angled to form a negative loft, the sole region offset with respect to the face.

2. The golf club of claim 1 in which the sole region is disposed below the face of the golf club head and at an angle different than the angle of the face of the golf club head.

3. The golf club of claim 1 in which the face of the golf club head defines a plane which intersects axis $L_1$ at a point above the golf club head.

4. The golf club of claim 1 in which the sole region defines a plane which intersects axis $L_1$ at a point above the golf club head.

5. The golf club of claim 1 in which the face of the golf club head defines a plane which intersects axis $L_1$ at a point above the golf club head and the sole region defines a plane which intersects axis $L_1$ at a point above the golf club head.

6. A golf club comprising:

a shaft having an axis $L_1$;

a hosel connected to the shaft; and a golf club head connected to the hosel the golf club head having a face and a sole region, the face angled to form a negative loft, the sole region offset with respect to the face, the sole region disposed below the face of the golf club head and at an angle different than the angle of the face of the golf club head, the face of the golf club head defining a plane which intersects axis $L_1$ at a point above the golf club head, the sole region defining a plane which also intersects axis $L_1$ at a point above the golf club head.

* * * * *